US009597241B2

(12) United States Patent
Zondervan et al.

(10) Patent No.: US 9,597,241 B2
(45) Date of Patent: Mar. 21, 2017

(54) LEVER-OPERATED WHEELCHAIR

(71) Applicant: The Regents of the University of California, Oakland, CA (US)

(72) Inventors: Daniel Zondervan, Long Beach, CA (US); David Reinkensmeyer, Irvine, CA (US); Brendan Smith, Long Beach, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 14/745,411

(22) Filed: Jun. 20, 2015

(65) Prior Publication Data

US 2016/0015580 A1 Jan. 21, 2016

Related U.S. Application Data

(60) Provisional application No. 62/014,963, filed on Jun. 20, 2014.

(51) Int. Cl.
*A61G 5/02* (2006.01)

(52) U.S. Cl.
CPC ..... *A61G 5/025* (2013.01); *A61G 5/024* (2013.01); *A61G 5/02* (2013.01)

(58) Field of Classification Search
CPC ..... A61G 5/025; A61G 5/02; A61G 5/024
USPC ..... 280/244
See application file for complete search history.

(56) References Cited

U.S. PATENT DOCUMENTS 5,242,179 A 9/1993 Beddome et al.
5,632,499 A * 5/1997 Hutcherson ..... A61G 5/023 280/246
5,657,836 A * 8/1997 BeVier ..... A61G 5/023 188/2 F
6,173,986 B1 * 1/2001 Sicher ..... A61G 5/023 280/242.1
6,247,715 B1 * 6/2001 Korosue ..... A61G 5/023 280/242.1
6,302,226 B1 10/2001 Kanno et al.
7,677,586 B2 3/2010 Bloom
7,717,447 B2 * 5/2010 Orford ..... A61G 5/025 280/210
7,837,210 B2 * 11/2010 Kylstra ..... A61G 5/023 280/244

(Continued)

OTHER PUBLICATIONS

J. Klein, S. J. Spencer, J. Allington, J. E. Bobrow, and D. J. Reinkensmeyer, "Optimization of a parallel shoulder mechanism to achieve a high force, low mass, robotic arm exoskeleton," IEEE Transactions on Robotics, vol. 26, pp. 710-715, 2010.

(Continued)

*Primary Examiner* — Tony Winner
*Assistant Examiner* — Michael Stabley
(74) *Attorney, Agent, or Firm* — Thomas | Horstemeyer, LLP

(57) ABSTRACT

In one embodiment, a wheelchair drive mechanism adapted to mount to a wheelchair includes a drive lever adapted to be rotated forward and rearward by a user of the wheelchair, a clutch mechanism associated with the drive lever, wherein actuation of the clutch mechanism causes the drive lever to be coupled to a wheel of the wheelchair such that they rotate together, and a clutch actuation device provided on the drive lever that is operable by the wheelchair user to actuate the clutch mechanism.

24 Claims, 7 Drawing Sheets

(56) References Cited

U.S. PATENT DOCUMENTS

| | | | |
|---|---|---|---|
| 8,087,684 | B2 | 1/2012 | Bloswick et al. |
| 8,186,699 | B2 | 5/2012 | Green |
| 2007/0284845 | A1 | 12/2007 | Roovers et al. |
| 2013/0324379 | A1 | 12/2013 | Zondervan et al. |

OTHER PUBLICATIONS

J. Klein, S. J. Spencer, and D. J. Reinkensmeyer, "Breaking it down is better: Haptic decomposition of complex movements aids in robot-assisted motor learning," IEEE Transactions on Neural Systems and Rehabilitation Engineering, p. epub ahead of print, 2012.
M. H. Milot, S. J. Spencer, V. Chan, J. P. Allington, J. Klein, C. Chou, J. E. Bobrow, S. C. Cramer, and D. J.Reinkensmeyer, "Re-training upper extremity movement with the robotic exoskeleton Bones after chronic stroke: a crossover pilot study evaluating the functional outcomes of more naturalistic robotic movement training," Journal of Neuroengineering and Rehabilitation, vol. 10, p. 112, 2013.
P. W. Blower, L. C. Carter, and D. A. Sulch, "Relationship Between Wheelchair Propulsion and Independent Walking in Hemiplegic Stroke," Stroke, vol. 26, pp. 606-608, 1995.
R. Singh, J. Hunter, A. Philip, and I. Todd, "Predicting those who will walk after rehabilitation in a specialist stroke unit.," Clin Rehabil., vol. 20, pp. 149-152, 2006.
S. McCombe Waller and J. Whitall, "Fine motor control in adults with and without chronic hemiparesis: baseline comparison to nondisabled adults and effects of bilateral arm training.," Arch Phys Med Rehabil, vol. 85, pp. 1076-1083, 2004.
S. J. Housman, K. M. Scott, and D. J. Reinkensmeyer, "A Randomized Controlled Trial of Gravity-Supported, Computer-Enhanced Arm Exercise for Individuals With Severe Hemiparesis," Neurorehabilitation and Neural Repair, vol. 23, pp. 505-514, 2009.
D. J. Reinkensmeyer, E. T. Wolbrecht, V. Chan, C. Chou, S. C. Cramer, and J. E. Bobrow, "Comparison of 3D, assist-as-needed robotic arm/hand movement training provided with Pneu-WREX to conventional table top therapy following chronic stroke," American Journal of Physical Medicine and Rehabilitation, p. To appear, 2012.
B. H. Dobkin, P. Plummer-D'Amato, R. Elashoff, and J. Lee, "International randomized clinical trial, stroke inpatient rehabilitation with reinforcement of walking speed (SIRROWS), improves outcomes.," Neurorehabil Neural Repair, vol. 24, pp. 235-242, 2010.
D. J. Gladstone, C. J. Danells, and S. E. Black, "The fugl-meyer assessment of motor recovery after stroke: a critical review of its measurement properties," Neurorehabilitation and neural repair, vol. 16, pp. 232-240, Sep. 2002.
J. See, L. Der-Yeghian, C. Chou, V. Chan, A. McKenzie, D. Reinkensmeyer, and S. Cramer, "A standardized approach to stroke outcome assessments. II. The Fugl-Meyer motor assessment," Neurorehabilitation and Neural Repair vol. 27, pp. 732-741, 2013.
J. H. van der Lee, H. Beckerman, D. L. Knol, H. C. W. de Vet, and L. M. Bouter, "Clinimetric properties of the Motor Activity Log for the assessment of arm use in hemiparetic patients," Stroke, vol. 35, pp. 1410-1404, 2004.
N. Friedman, J. B. Rowe, D. J. Reinkensmeyer, and M. Bachman, "The manumeter: A wearable device for monitoring daily use of the wrist and fingers," Journal of Biomedical and Health Informatics, vol. epub ahead of print, 2014.
J. Rowe, N. Friedman, V. Chan, S. Cramer, M. Bachman, and D. Reinkensmeyer, "The Variable Relationship between Arm and Hand Use: A Rationale for Using Finger Magnetometry to Complement Wrist Accelerometry When Measuring Daily Use of the Upper Extremity" Proceedings 36th Annual International IEEE EMBS Conference, Aug. 26-30., vol. To appear, 2014.
J. Cohen, Statistical power analysis for the behavioral sciences: Hillsdale, NJ: Lawrence Earlbaum Associates, 1988.
S. M. Michaelsen, R. Dannenbaum, and M. F. Levin, "Task-specific training with trunk restraint on arm recovery in stroke: randomized control trial," Stroke, vol. 37, pp. 186-192, 2006.
H. Day and J. Jutai, "Measuring the psychosocial impact of assistive devices: the PIADS," Candadian Journal of Rehabilitation, vol. 9, pp. 159-168, 1996.
L. Demers, R. Weiss-Lambrou, and B. Ska, "Development of the Quebec User Evaluation of Satisfaction with assistive Technology (QUEST)." Assist Technol, vol. 8, pp. 3-13, 1996.
Foreign search report for PCT/US15/36848 dated Sep. 16, 2015.
D. K. Zondervan, V. Chan, B. Bodenhofer, R. Augsburger, D. J. Reinkensmeyer, and S. C. Cramer, "Machine-based, self-guided home therapy for individuals with severe arm impairment after stroke: a randomized controlled trial," Neural Rehabilitation and Neural Repair, vol. conditionally accepted, 2014.
D. U. Jette, N. K. Latham, R. J. Smout, J. Gassaway, M. D. Slavin, and S. D. Horn, "Physical therapy interventions for patients with stroke in inpatient rehabilitation facilities," Phys Ther, vol. 85, pp. 238-248, 2005.
V. Y. Ma, C. L., and C. K.J., "The Incidence, Prevalence, Costs and Impact on Disability of Common Conditions Requiring Rehabilitation in the US: Stroke, Spinal Cord Injury, Traumatic Brain Injury, Multiple Sclerosis, Osteoarthritis, Rheumatoid Arthritis, Limb Loss, and Back Pain.," Arch Phys Med Rehabil, vol. epub ahead of print, 2014.
B. H. Dobkin, Neurologic Rehabilitation. Philadelphia: F.A. Davis Company, 1996.
T. Warabi, K. Inoue, H. Noda, and S. Murakami, "Recovery of voluntary movement in hemiplegic patients: Correlation with degenerative shrinkage of the cerebral peduncles in CT images," Brain, vol. 113, pp. 177-189, 1990.
A. Heller, D. T. Wade, V. A. Wood, A. Sunderland, R. L. Hewer, and E. Ward, "Arm function after stroke: measurement and recovery over the first three months," Journal of neurology, neurosurgery, and psychiatry, vol. 50, pp. 714-719, Jun. 1987.
C. E. Lang, M. J.R., D. S. Reisman, L. Boyd, K. T. Jacobson, S. M. Schindler-Ivens, T. G. Hornby, S. A. Ross, and P.L. Scheets, "Observation of amounts of movement practice provided during stroke rehabilitation.," Arch Phys Med Rehabil, vol. 90, pp. 1692-1698, 2009.
K. R. Lohse, C. E. Lang, and L. A. Boyd, "Is more better? Using metadata to explore dose-response relationships in stroke rehabilitation.," Stroke, vol. 45, pp. 2053-2058, 2014.
J. Biernaskie, G. Chernenko, and D. Corbett, "Efficacy of rehabilitative experience declines with time after focal ischemic brain injury," The Journal of neuroscience : the official journal of the Society for Neuroscience, vol. 24, pp. 1245-1254, Feb. 4, 2004.
S. C. Cramer, "Repairing the human brain after stroke: I. Mechanisms of spontaneous recovery," Annals of Neurology, vol. 63, pp. 272-287, Mar. 2008.
C. Stinear, A. S., and B. W, "Rehabilitation is Initiated Early After Stroke, but Most Motor Rehabilitation Trials Are Not: A Systmatic Review.," Stroke, vol. 44, pp. 2039-2045, 2013.
B. W. Smith, D. Zondervan, T. J. Lord, V. Chan, and D. J. Reinkensmeyer, "Feasibility of a bimanual, lever-driven wheelchair for people with wevere arm impairment after stroke," 36th Annual International IEEE EMBS Conference, Aug. 26-30, vol. To appear, 2014.
T. West and J. Bernhardt, "Physical activity in hospitalised stroke patients," Stroke research and treatment, vol. 2012, p. 13 pages, 2012.
J. A. Barrett, C. Watkins, R. Plant, H. Dickinson, L. Clayton, A. K. Sharma, A. Reston, J. Gratton, S. Fall, A. Flynn, T. Smith, M. Leathley, S. Smith, and D. H. Barer, "The COSTAR wheelchair study: a two-centre pilot study of self-propulsion in a wheelchair in early stroke rehabilitation," Clin Rehabil, vol. 15, pp. 32-41, 2001.
L. Sawaki, "Use-dependent plasticity of the human motor cortex in health and disease," IEEE Eng Med Biol Mag, vol. 24, pp. 36-39., Jan.-Feb. 2005.
L. Ada, S. Dorsch, and C. G. Canning, "Strengthening interventions increase strength and improve activity after stroke: a systematic review," The Australian journal of physiotherapy, vol. 52, pp. 241-248, 2006.

(56) References Cited

OTHER PUBLICATIONS

J. van der Lee, I. Snels, H. Beckerman, G. Lankhorst, R. Wagenaar, and L. Bouter, "Exercise therapy for arm function in stroke patients: a systematic review of randomized controlled trial," Clinical Rehabilitation, vol. 15, pp. 20-31, 2001.
M. G. Kloosterman, G. J. Snoek, and M. J. Jannink, "Systematic review of the effects of exercise therapy on the upper extremity of patients with spinal-cord injury," Spinal cord : the official journal of the International Medical Society of Paraplegia, Sep. 30, 2008.
R. J. Nudo, "Postinfarct cortical plasticity and behavioral recovery," Stroke; a journal of cerebral circulation, vol. 38, pp. 340-845, Feb. 2007.
G. Kwakkel, B. J. Kollen, and H. I. Krebs, "Effects of robot-assisted therapy on upper limb recovery after stroke: a systematic review," Neurorehabilitation and neural repair, vol. 22, pp. 111-121, Mar.-Apr. 2008.
J. Mehrholz, T. Platz, J. Kugler, and M. Pohl, "Electromechanical and robot-assisted arm training for improving arm function and activities of daily living after stroke," Cochrane database of systematic reviews (Online), vol. (4), p. CD006876, Oct. 8, 2008.
B. Prange, M. J. A. Jannink, C. G. M. Groothuis, H. J. Hermens, and M. J. Ijzerman, "Systematic review of the effect of robot-aided therapy on recovery of the hemiparetic arm after stroke," J. Rehabil. Res. Develop, vol. 43, pp. 171-184, 2006.
J. H. Burridge and A. M. Hughes, "Potential for new technologies in clinical practice.," Curr Opin Neurol, vol. 23, pp. 571-577, 2010.
S. Brochard, J. Robertson, B. Médée, and O. Rémy-Néris, "What's new in new technologies for upper extremity rehabilitation?," Curr Opin Neurol, 2010.
J. R. Carey, W. K. Durfee, E. Bhatt, A. Nagpal, S. A. Weinstein, K. M. Anderson, and S. M. Lewis, "Comparison of finger tracking versus simple movement training via telerehabilitation to alter hand function and cortical reorganization after stroke," Neurorehabilitation and neural repair, vol. 21, pp. 216-232, May-Jun. 2007.
S. V. Adamovich, A. S. Merians, R. Boian, J. A. Lewis, M. Tremaine, G. S. Burdea, M. Recce, and H. Poizner, "A Virtual Reality-Based Exercise System for Hand Rehabilitation Post-Stroke," Presence: Teleoperators & Virtual Environments, vol. 14, pp. 161-174, 2005.
A. Ashburn and M. Lynch, "Disadvantages of the early use of wheelchairs in the treatment of hemiplegia," Clin. Rehabil, vol. 2, pp. 327-331, 1988.
D. K. Zondervan, B. Smith, and D. J. Reinkensmeyer, "Lever-actuated resonance assistance (LARA): A wheelchair-based method for upper extremity therapy and overground ambulation for people with severe arm impairment," International Conference on Rehabilitation Robotics, vol. 6650400, 2013.
D. Zondervan, L. Palofax, J. Hernandez, and D. J. Reinkensmeyer, "The resonating arm exerciser: A simple rehabilitation device that mimics robotic active assistance" Journal of Neuroengineering and Rehabilitation, vol. 10, p. 39, 2013.
N. Schweighofer, C. E. Han, S. L. Wolf, M. A. Arbib, and C. J. Winstein, "A functional threshold for long-term use of hand and arm function can be determined: predictions from a computational model and supporting data from the Extremity Constraint-Induced Therapy Evaluation (EXCITE) Trial.," Phys Ther, vol. 89, pp. 1327-1336, 2009.
N. Friedman, V. Chan, D. Zondervan, M. Bachman, and D. J. Reinkensmeyer, "MusicGlove: motivating and quantifying hand movement rehabilitation by using functional grips to play music," Proceedings 2011 IEEE Engineering in Medicine and Biology Conference, pp. 2359-2363, 2011.
N. Friedman, V. Chan, A. N. Reinkensmeyer, A. Beroukhim, G. Zambrano, M. Bachman, and D. J. Reinkensmeyer, "Retraining and assessing hand movement after stroke using the MusicGlove: Comparison with conventional hand therapy and isometric grip training," Journal of Neuroengineering and Rehabilitation Research, vol. 11, p. 76, 2014.
W. Rosamond, K. Flegal, K. Furie, A. Go, K. Greenlund, H. Haase, S. M. Hailpern, M. Ho, V. Howard, B. Kissela, S. Kittner, D. Lloyd-Jones, M. McDermott, J. Meigs, C. Moy, G. Nichol, C. O'Donnell, V. Roger, P. Sorlie, J. Steinberger, T. Thom, M. Wilson, Y. Hong, C. for the American Heart Association Statistics, and S. Stroke Statistics, "Heart Disease and Stroke Statistics—2008 Update: A Report From the American Heart Association Statistics Committee and Stroke Statistics Subcommittee," Circulation, vol. 117, pp. e25-e146, Jan. 29, 2008.
R. K. Bode, A. W. Heinemann, P. Semik, and T. Mallinson, "Relative importance of rehabilitation therapy characteristics on functional outcomes for persons with stroke," Stroke; a journal of cerebral circulation, vol. 35, pp. 2537-2542, Nov. 2004.
N. N. Byl, E. A. Pitsch, and G. M. Abrams, "Functional outcomes can vary by dose: learning-based sensorimotor training for patients stable poststroke," Neurorehabilitation and neural repair, vol. 22, pp. 494-504, Sep.-Oct. 2008.
G. Kwakkel, "Impact of intensity of practice after stroke: Issues for consideration," Disability & Rehabilitation, vol. 28, pp. 823-830, 2006.
G. Kwakkel, R. C. Wagenaar, J. W. Twisk, G. J. Lankhorst, and J. C. Koetsier, "Intensity of leg and arm training after primary middle-cerebral-artery stroke: a randomised trial," Lancet, vol. 354, pp. 191-196, Jul. 17, 1999.
R. Teasell, J. Bitensky, K. Salter, and N. A. Bayona, "The role of timing and intensity of rehabilitation therapies," Topics in Stroke Rehabilitation, vol. 12, pp. 46-57, Summer 2005.
J. A. Barrett, C. Watkins, and R. Plant, "The COSTAR wheelchair study: a two-centre pilot study of self-propulsion in a wheelchair in early stroke rehabilitation," Clin Rehabil, vol. 15, pp. 32-41, 2001.
V. M. Pomeroy, J. Mickelborough, E. Hill, P. Rodgers, and G. Giakas, "A hypothesis: self-propulsion in a wheelchair early after stroke might not be harmful" Clin. Rehabi, vol. 17, pp. 174-180, 2003.
S. D. Algood, R. A. Cooper, S. G. Fitzgerald, R. Cooper, and M. L. Boninger, "Effect of a pushrim-activated power-assist wheelchair on the functional capabilities of persons with tetraplegia.," Archives of physical medicine and rehabilitation, vol. 86, pp. 380-386, 2005.
R. a. Cooper, T. A. Coffman, S. G. Fitzgerald, M. L. Boninger, D. M. Spaeth, W. Ammer, and J. Arva, "Performance assessment of a pushrim-activated power-assisted wheelchair control system," IEEE Transactions on Control Systems Technology, vol. 10, pp. 121-126, 2002.
R. a. Cooper, S. G. Fitzgerald, M. L. Boninger, K. Prins, a J. Rentschler, J. Arva, and T. J. O'connor, "Evaluation of a pushrim-activated, power-assisted wheelchair.," Archives of physical medicine and rehabilitation, vol. 82, pp. 702-708, 2001.
D. Ding, A. Souza, R. a. Cooper, S. G. Fitzgerald, R. Cooper, A. Kelleher, and M. L. Boninger, "A preliminary study on the impact of pushrim-activated power-assist wheelchairs among individuals with tetraplegia.," American journal of physical medicine & rehabilitation / Association of Academic Physiatrists, vol. 87, pp. 821-829, 2008.
A. Karmarkar, R. a. Cooper, H.-y. Liu, S. Connor, and J. Puhlman, "Evaluation of pushrim-activated power-assisted wheelchairs using ANSI/RESNA standards.," Archives of physical medicine and rehabilitation, vol. 89, pp. 1191-1198, 2008.
D. J. Reinkensmeyer, L. E. Kahn, M. Averbuch, A. McKenna-Cole, B. D. Schmit, and W. Z. Rymer, "Understanding and treating arm movement impairment after chronic brain injury: progress with the Arm guide," J Rehabil Res Dev, vol. 37, pp. 653-662, 2000.
R. J. Sanchez, J. Liu, S. Rao, P. Shah, R. Smith, S. C. Cramer, J. E Bobrow, and D. J. Reinkensmeyer, "Automating arm movement training following severe stroke: functional exercises with quantitative feedback in a gravity-reduced environment," IEEE Transactions on Neural and Rehabilitation Engineering, vol. 14, pp. 378-389, 2006.
E. T. Wolbrecht, V. Chan, D. J. Reinkensmeyer, and J. E. Bobrow, "Optimizing compliant, model-based robotic assistance to promote neurorehabilitation," IEEE Transactions Neural Systems and Rehabiltation Engineering, vol. 16, pp. 286-297, 2008.

* cited by examiner

LEVER-OPERATED WHEELCHAIR

CROSS-REFERENCE TO RELATED APPLICATION

This application claims priority to U.S. Provisional Application Ser. No. 62/014,963, filed Jun. 20, 2014, which is hereby incorporated by reference herein in its entirety.

NOTICE OF GOVERNMENT-SPONSORED RESEARCH

This invention was made with Government support under grant/contract number H133E120010, awarded by the National Institute on Disability and Rehabilitation Research (NIDRR). The Government has certain rights in the invention.

BACKGROUND

After having a stroke, a patient normally spends time in a hospital where he or she can be observed and provided with care until becoming healthy enough for discharge. During the hospital stay, the patient is typically moved from place-to-place within the hospital or to other health care facilities with a wheelchair that is pushed by hospital staff. While such movement is effective, it does not require any effort on the part of the patient. This is unfortunate as a patient's limbs, including the arms, are often weak after a stroke and requiring the patient to use the arms to propel the wheelchair could help restore the patient's arm strength and function.

Although conventional wheelchairs often have hoops mounted to the wheels that enable healthy individuals to drive the chair, stroke patients often lack the strength and/or range of motion to propel the wheelchair in this manner. While other manual drive mechanisms have been developed beyond wheel hoops, they also normally require strength or a range of motion that recent stroke victims do not possess.

In view of the above discussion, it can be appreciated that it would be desirable to have a wheelchair that can be more easily manually operated by a user sitting in the chair.

BRIEF DESCRIPTION OF THE DRAWINGS

The present disclosure may be better understood with reference to the following figures. Matching reference numerals designate corresponding parts throughout the figures, which are not necessarily drawn to scale.

DETAILED DESCRIPTION

As described above, it can be appreciated that it would be desirable to have a wheelchair that can be more easily manually operated by a user sitting in the chair. Disclosed herein are examples of such wheelchairs and their components. The wheelchairs comprise drive levers that can be moved forward and rearward by the user to manually propel the wheelchair. In some embodiments, forearm supports are mounted to the levers that help support the user's arms and therefore facilitate manipulation of the levers. In addition, tensioning mechanisms are associated with the levers that apply tension to the levers that opposes both forward and rearward movement of the levers. As is described below, such tension can assist the user in both driving and stopping the wheelchair.

In the following disclosure, various specific embodiments are described. It is to be understood that those embodiments are example implementations of the disclosed inventions and that alternative embodiments are possible. All such embodiments are intended to fall within the scope of this disclosure.

Figure 1:
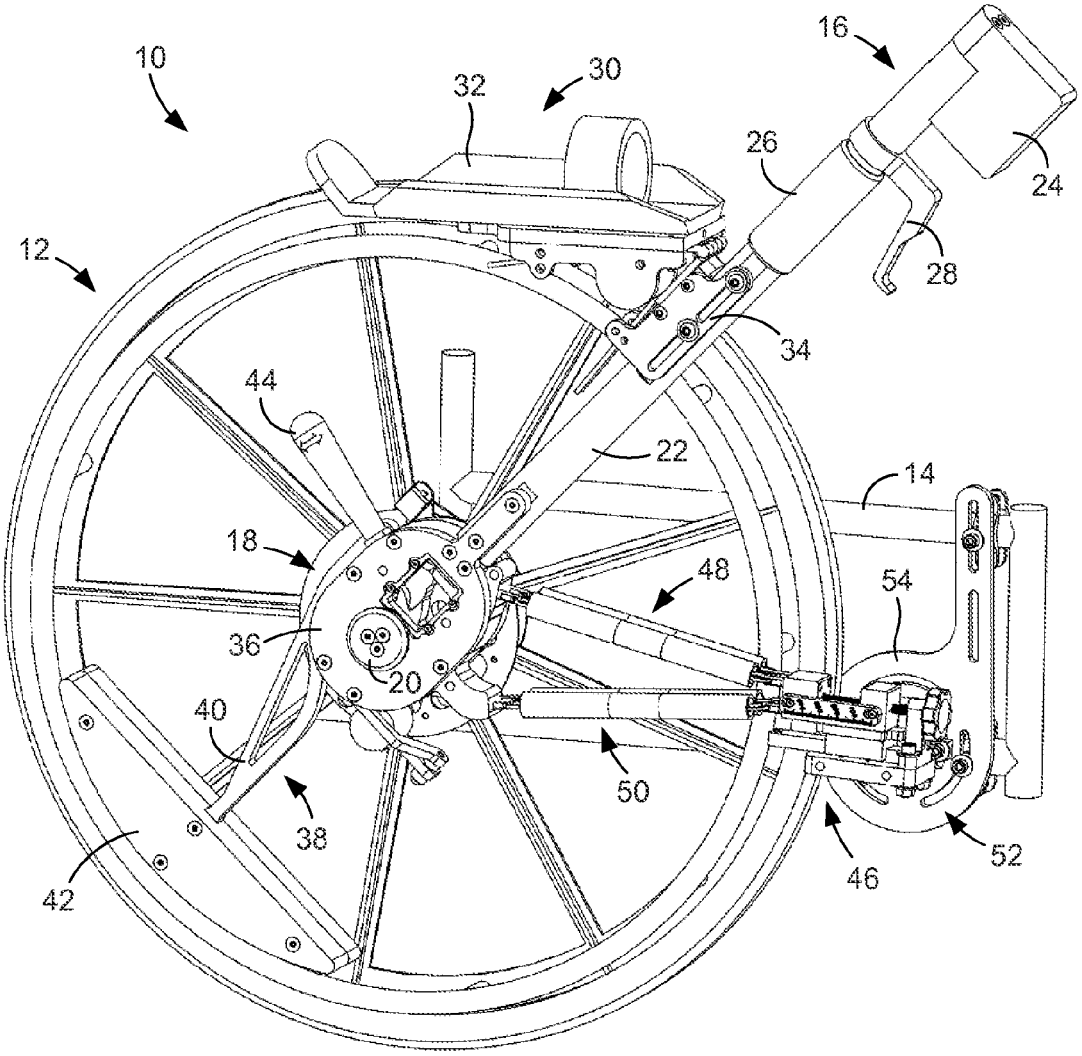
FIG. 1 is a side perspective view of a first embodiment of a wheelchair drive mechanism attached to the wheel and frame of a wheelchair.

FIG. 1 illustrates a first embodiment of a wheelchair drive mechanism 10. Although only one such mechanism 10 is shown, it is noted that a wheelchair can be provided with two such mechanisms, one for each rear wheel of the chair. The drive mechanism 10 is shown mounted to a rear wheel 12 and a frame 14 of a wheelchair. As indicated in FIG. 1, the drive mechanism 10 includes a drive lever 16 that extends outward from the center (axis) of the wheel 12. In the illustrated embodiment, the lever 16 is securely mounted to an optional transmission 18, which is rotatably mounted to a wheel axle 20 to which the wheel 12 is fixedly attached. As such, the transmission 18 and the lever 16 can rotate relative to both the axle 20 and the wheel 12.

In the illustrated embodiment, the drive lever 16 comprises an elongated shaft 22, such as a hollow tube. The shaft 22 extends radially outward from the wheel 12 and its distal end terminates at a position well beyond the outer periphery of the wheel. Mounted to the distal end of the shaft 20 is a weight 24 that, as is described below, helps to both balance the lever 16 and facilitate harmonic resonance of the lever. Located at a position along the shaft 22 proximal of the weight 24 is a hand grip 26 that is adapted to be gripped by the wheelchair user. By way of example, the hand grip 26 is made of a resilient, non-slip material. Positioned adjacent to the hand grip 26 is a clutch actuation device, in the form of a clutch lever 28, which can be used to operate a clutch mechanism associated the wheel 12. Located at a position proximal of the hand grip 26, but still beyond of the periphery of the wheel 12, is a forearm support 30 that is adapted to support a forearm of the wheelchair user. In the illustrated embodiment, the support 30 includes a forearm trough 32 that is secured to the shaft 22 with a mounting bracket 34.

As indicated above, the drive lever 16 is attached to the transmission 18 so that the lever rotates along with the transmission. More particularly, the lever 16 is attached to a housing 36 of the transmission 18, which acts as a mounting member for the lever. Also attached to the transmission housing 36 is a counterweight armature 38 that extends radially outward from the axis the wheel 12 in a direction opposite to that of the lever 16. The armature 38 includes an elongated arm 40 having a counterweight 42 that is mounted to its distal end at a position near the outer periphery of the wheel 12. Like the weight 24, the counterweight 42 helps to both balance the lever 16 and facilitate harmonic resonance of the lever.

With further reference to FIG. 1, extending outward from the transmission 18 is a selection lever 44 that can be used to place the transmission in one of two different configurations, which are described below in relation to FIGS. 5 and 6.

Further connected to the transmission housing 36 is a tensioning mechanism 46 that applies tension to the transmission housing and, therefore, the drive lever 16. The tensioning mechanism 46 includes a first or upper tensile member 48 and a second or lower tensile member 50. These tensile members 48, 50 are attached at first ends to the transmission housing 36 at positions above and below the axle 20 of the wheel 12, and are attached at second ends to a tension adjustment mechanism 52. As shown in FIG. 1, the first ends of the tensile members 48, 50 are spaced from each other while the second ends of the tensile members are positioned close to each other such that tensile members and the transmission housing 36 together form a triangle. The tension adjustment mechanism 52 is connected to a mounting plate 54, which is mounted to the frame 14 of the wheelchair.

Figure 2:
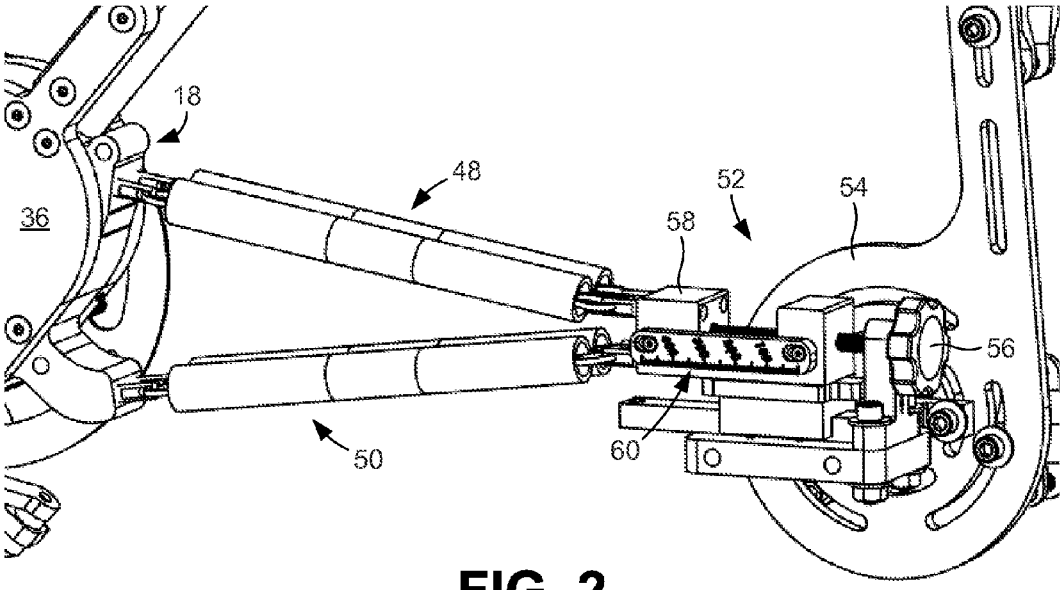
FIG. 2 is a detail view of a tensioning mechanism of the wheelchair drive mechanism of FIG. 1.

The tensioning mechanism 46 is shown more clearly in the detail view of FIG. 2. The tensile members 48, 50 can comprise any element that can provide tensile resistance to rotation of the transmission housing 36 and, therefore, the drive lever 16. In some embodiments, the tensile members 48, 50 comprise one or more stretched springs or elastic bands. As noted above, the level of tension in the tensile members 48, 50 can be adjusted using the tension adjustment mechanism 52. In particular, an adjustment knob 56 of the mechanism 52 can be rotated to either increase or decrease the tension applied by the tensile members 48, 50. More particularly, rotation of the knob 56 causes linear displacement of a block 58 to which each tensile member 48, 50 is attached. A scale 60 can be provided to give the user an indication of the magnitude of the tension that is applied. Regardless of the level of tension that is applied, the tensile members 48, 50 are held in tension irrespective of the angular position of the transmission housing 36 and lever 16. In such a case, the tensile members 48, 50 continuously pull on the transmission housing 36, which facilitates the harmonic resonance of the lever 16.

In addition to facilitating harmonic resonance of the drive lever 16, the tensioning mechanism 46 serves several other purposes. For example, the tensioning mechanism 46 supports the weight of the lever 16 against gravity. The tensioning mechanism 46 therefore prevents the lever 16 from rotating forward or backward if a user were to release the lever when it is not engaged with the wheel 12. In addition, the tensioning mechanism 46 defines a neutral or resting point for the lever 16 during operation. This ensures that a user manipulates the lever 16 within a consistent range of motion, which improves the ergonomics of the device and can prevent long-term injuries at the shoulder from, for example, over-extension of shoulder and elbow during use. Furthermore, in embodiments in which the wheelchair drive mechanism 10 comprises a clutch mechanism that can be used to drive and stop the wheelchair (described below in relation to FIG. 3), the act of braking the wheelchair by engaging the clutch would transfer the braking force into the levers and, by extension, into a user's arms. This could be uncomfortable and potentially dangerous. However, with the tensioning mechanism 46 integrated into the drive mechanism 10, the braking force is counteracted by the force of the tensile members 48, 50, thus reducing strain on the arm during braking and preventing the lever 16 from being displaced outside of a comfortable range of motion.

Figure 3:
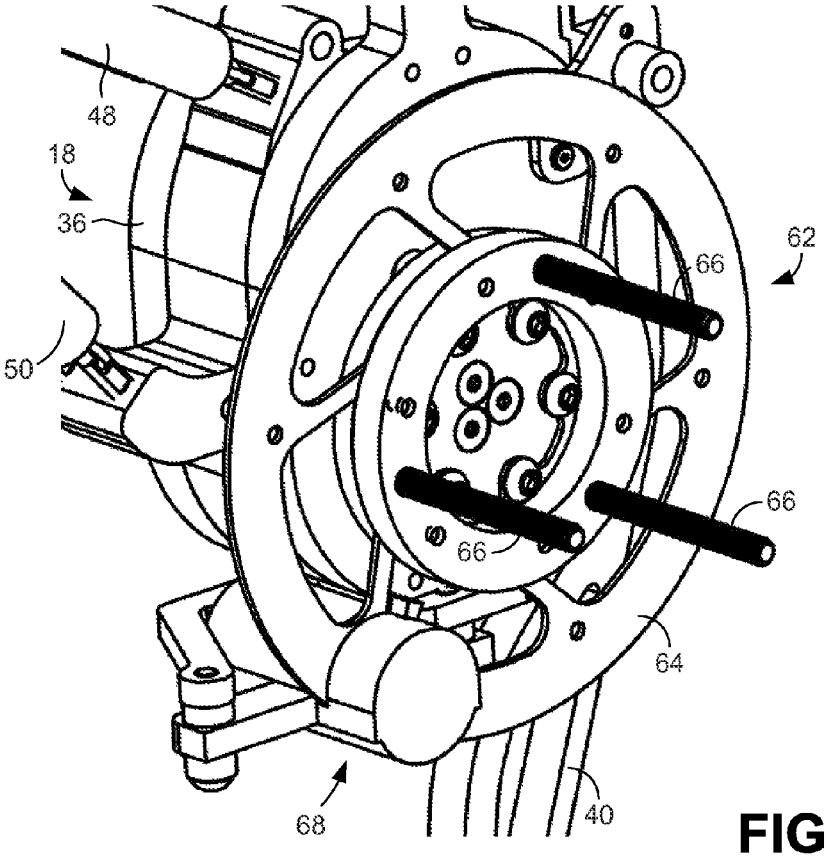
FIG. 3 is a detail view of a clutch mechanism of the wheelchair drive mechanism of FIG. 1.
Figure 4:
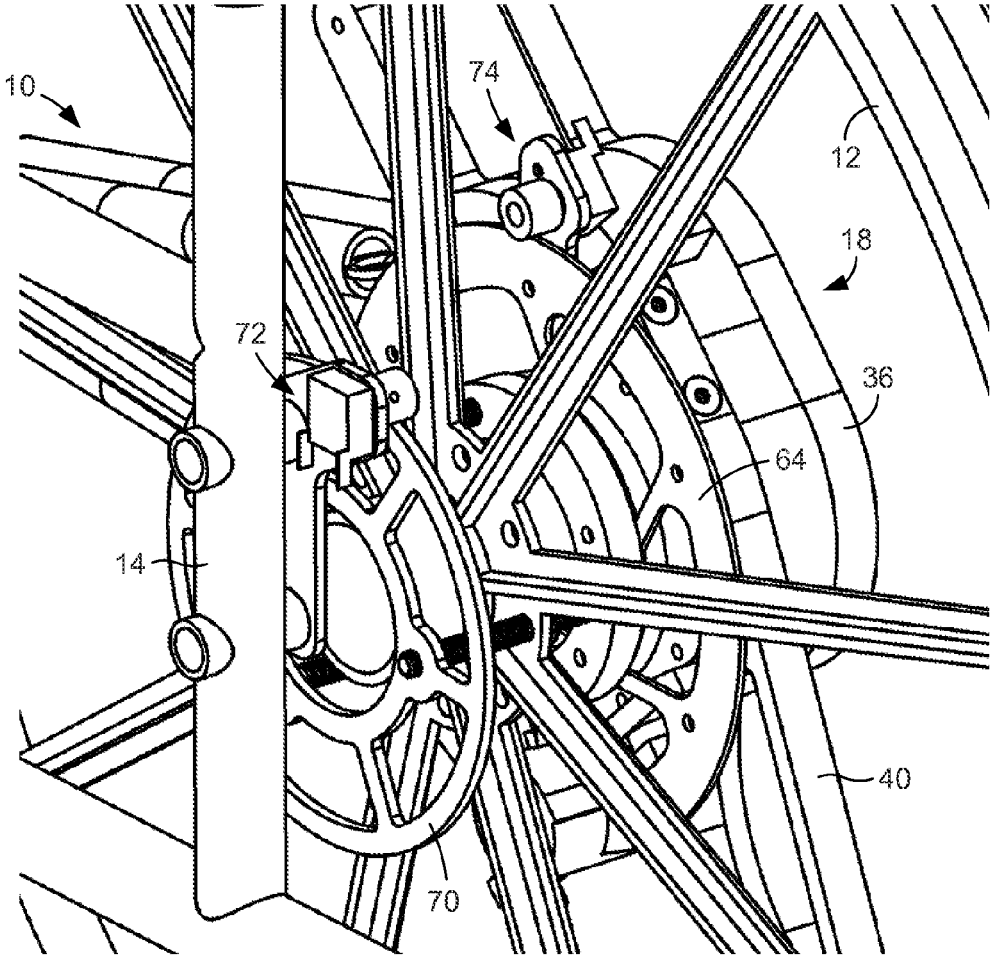
FIG. 4 is a detail view of the wheelchair drive mechanism of FIG. 1 showing sensors used to automatically control a clutch mechanism of the wheelchair drive mechanism.

Turning next to FIG. 3, illustrated is a clutch mechanism 62 that can be used to mechanically couple the drive lever 16 to the wheel 12 to enable the user to both propel and stop the wheelchair using the lever. In the example of FIG. 4, the clutch mechanism 62 includes a brake disc 64 that is directly mounted to the wheel 12 with threaded studs 66 and therefore rotates with the wheel. In addition, the clutch mechanism 62 includes brake calipers 68 that are mounted to the transmission housing 36, which are activated when the user squeezes the clutch lever 28 provided near the hand grip 26. When the clutch lever 28 is squeezed, the brake calipers 68 grip the brake disc 64 and place the wheelchair drive mechanism 10 in a "direct-coupling" mode in which the wheel 12 is directly coupled with the drive lever 16 and will rotate with it (and vice versa).

To propel the wheelchair forward, the user can squeeze the clutch lever 28 when the drive lever 16 is in an initial rearward position and, while still squeezing the clutch lever, push the lever forward to cause the wheel 12 to rotate in a forward direction. Once the drive lever 16 has been pushed to a forward position at which the user's arm is extended, the user can then release the clutch lever 28, retract the lever back to the rearward position, and repeat the process to further rotate the wheel 12 in the forward direction. Rotation in the reverse direction can be achieved using an inverse process. Specifically, when the drive lever 16 is in an initial forward position, the user can squeeze the clutch lever 28 and pull the lever rearward to cause the wheel 12 to rotate in a rearward direction. Once the drive lever 16 has been pulled to a rearward position at which the user's arm is bent (e.g., near 90°), the user can then release the clutch lever 28, push the lever back to the forward position, and repeat the process to further rotate the wheel 12 in the rearward direction. Both forward and rearward rotation of the wheel 12 can be halted by opposing such rotation with the lever 16 when the clutch lever 28 is activated.

As can be appreciated from the above description of operation of the clutch mechanism 62, several different types of drive operations can be performed. For example, the user can drive both wheels 12 forward to drive the wheelchair forward, drive both wheels backward to drive the wheelchair backward, or drive one wheel forward while driving another wheel backward to cause the wheelchair to rotate in place. Irrespective of the drive operation, the user is required to coordinate actuation of the clutch lever 28 with pulling or pushing of the drive lever 16, which may increase the speed of recovery of the user's arm and hand coordination, strength, and range of motion. In some embodiments, a single clutch lever 28 simultaneously operates the clutch mechanisms 62 of each rear wheel 12.

It is further noted that the drive levers 16 can be used even when the clutch mechanism 62 is not engaged. Specifically, when the drive levers 16 are disengaged from the wheels 12, the user can operate the wheelchair drive mechanism 10 in a "freewheeling" mode and simply push and pull the drive levers against the tension provided by the tensioning mechanism 46 to exercise the arms without ambulation. Therefore, the user can exercise his or her arms with relatively little resistance, with harmonic resonance, and without moving the wheelchair from its position. In some embodiments, such exercise can be performed while playing a game, such as an interactive video game in which movement of the lever 16 results in some action occurring within the game.

It is noted that, in some embodiments, the clutch mechanism 62 can be automatically engaged and disengaged by an onboard computer that processes signals from sensors mounted on the wheelchair and manages the timing of switching between freewheeling and direct-coupling modes to achieve different user-specified manners of operation, such as forward movement, backward movement, and direct coupling. FIG. 4 illustrates an example of such an automated embodiment. As shown in this figure, the wheelchair drive mechanism 10 can further include a disc 70 that is securely mounted to the wheel 12. Associated with this disc is a first rotary encoder 72 that is configured to measure the speed with which the disc 70, and therefore the wheel 12, rotates. A second rotary encoder 74 is associated with the brake disc 64 and is configured to measure the speed with which the disc, and therefore the lever 16, rotates. With such apparatus, timing can be optimized such that, when forward driving is desired, the direct-coupling mode is engaged at the precise moment when the forward rotational speed of the drive lever 16 becomes greater than the rotational speed on the wheel 12, and the freewheeling mode is engaged at the precise moment when the forward rotation speed of the lever becomes less than the rotation speed of the wheel. The transition between the freewheeling and direct-coupling modes can be smoothed by controlling the rate at which the clutch mechanism 62 is automatically engaged. This achieves a smoothness not possible through use of a conventional one-way clutch. The desired mode of operation (e.g., forward driving, rearward driving, etc.) can, for example, be controlled using buttons on a control panel positioned adjacent to the handgrip 24 of the drive lever 16.

In addition, certain actions, such as stopping the wheelchair, can be mapped to simple reflexive motions, such as pulling and holding the drive levers in a rearward position (a likely reflex when wanting the chair to stop) or accidentally letting go of a lever such that users with impaired coordination can use the device safely. Such an embodiment emulates all behaviors possible with one-way clutch based devices, but does so with reduced mechanical complexity.

Figure 5A:
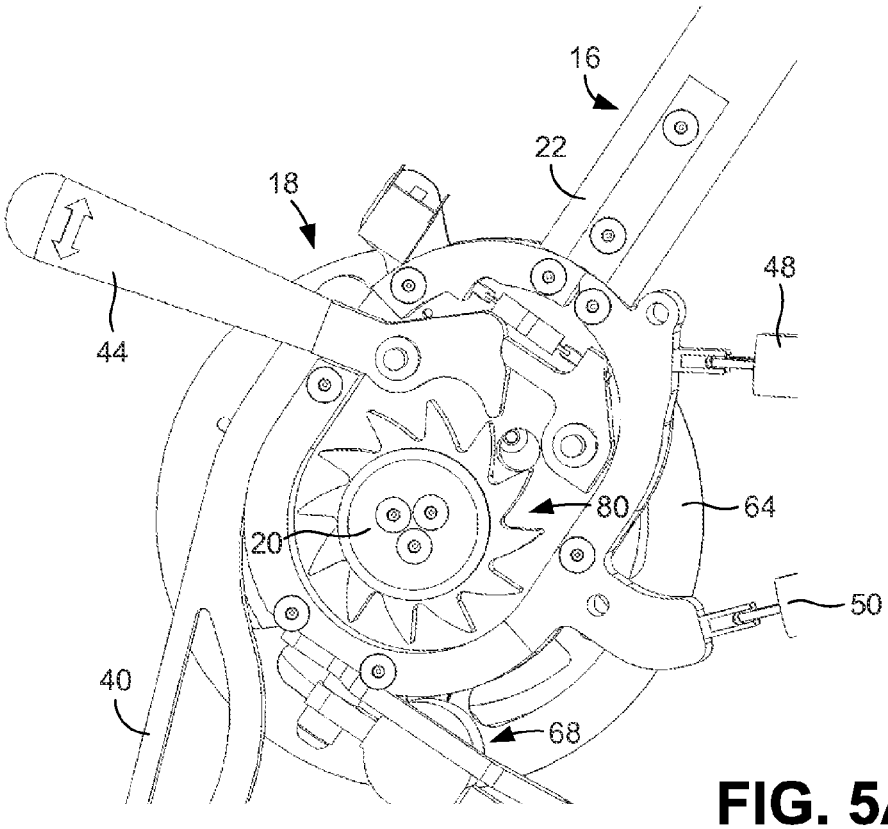
FIGS. 5A and 5B are detail views of a transmission of the wheelchair drive mechanism of FIG. 1, illustrating two different configurations of the transmission.
Figure 5B:
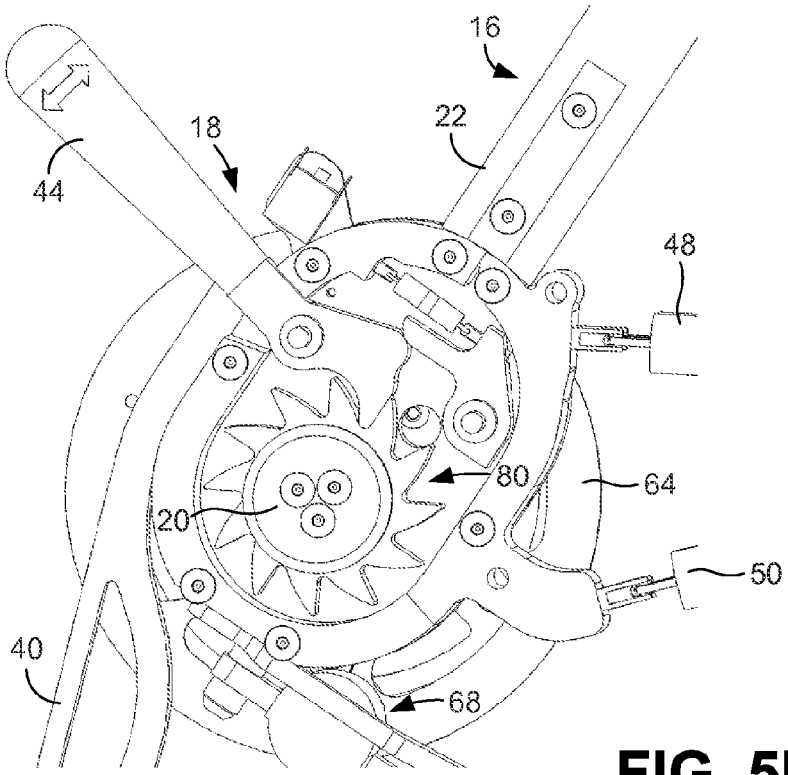

When provided, the transmission 18 enables further types of drive operation. FIGS. 5A and 5B show the internal components of the transmission 18 (part of the transmission housing 36 has been removed) and illustrate the two configurations in which the transmission can be placed. The transmission 18 includes an internal gear 80 that is coupled to the axle 20 of the wheel 12 with a one-way clutch mechanism (not visible) that enables the gear to drive the wheel in the forward direction but idle as the wheel 12 rotates in that direction. FIG. 5A shows a freewheeling configuration of the transmission 18 in which the selection lever 44 is moved to a position in which it does not interface with the teeth of the gear 80. When the selection lever 44 is in this position, the drive lever 16 is decoupled from the wheel 12 and movement of the lever, whether in the forward or rearward direction, has no effect on the wheel, unless the clutch lever 28 is squeezed as described above.

FIG. 5B shows a driving configuration of the transmission 18 in which the selection lever 44 directly interfaces with the teeth of the gear 80. When the selection lever 44 is in this position, forward motion of the drive lever 16 causes the wheel 12 to rotate in the forward direction but rearward motion of the lever does not affect rotation of the wheel. Accordingly, the driving configuration of the transmission 18 can be used to drive the wheelchair forward without requiring the user to operate the clutch mechanism 62. The clutch mechanism 62 could, however, still be used as a brake in that context.

Irrespective of whether the wheelchair is driven forward using the clutch mechanism 62 or the transmission 18 when in its driving configuration, the tensioning mechanism 46, the weight 24, and the counterweight 42 together create a system with a low damping ratio (e.g., approximately 0.01-0.707) that helps the user generate harmonic resonance (e.g., at a frequency of approximately 0.5 to 1.5 Hz) that assists the user in maintaining the back-and-forth motion of the lever 16 and increases the user's range of motion. In addition, the tensioning mechanism 46, and specifically the tensile member 50, assists the user in slowing forward wheel rotation during braking, because the member is stretched as the drive lever 16 is moved forward due to the rotation of the wheel 12.

Figure 6:
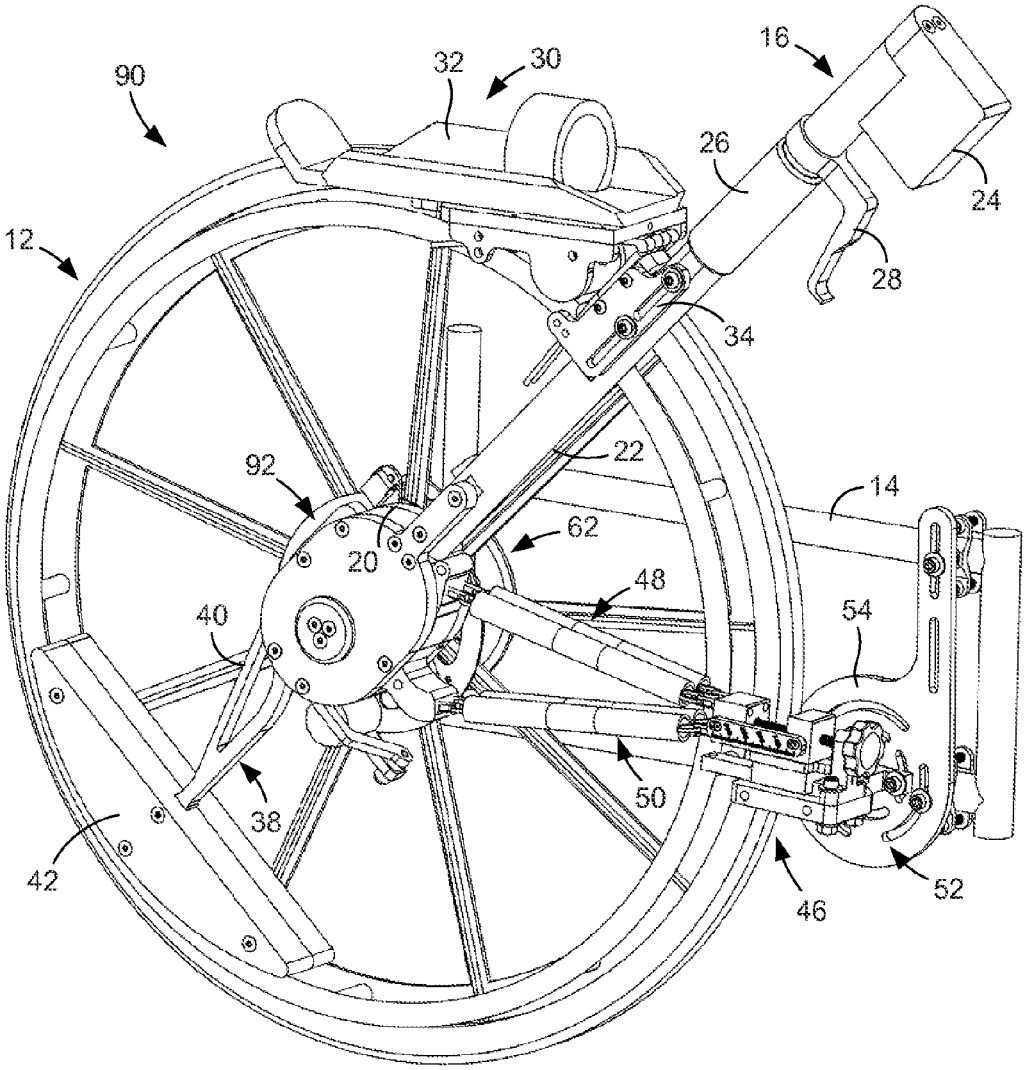
FIG. 6 is a side perspective view of a second embodiment of a wheelchair drive mechanism attached to the wheel and frame of a wheelchair.

FIG. 6 illustrates a second embodiment of a wheelchair drive mechanism 90 that is similar in many ways to the mechanism 10 described above. As indicated in FIG. 6, the drive mechanism 90 also includes a drive lever 16 that comprises an elongated shaft 22 to which a weight 24, hand grip 26, and clutch actuation device 28 are mounted. Further mounted to the shaft 22 is a forearm support 30 that includes a forearm trough 32 that is secured to the shaft with a mounting bracket 34.

With further reference to FIG. 6, the drive lever 16 is attached to a mounting member 92 that, like the transmission housing 36 of the first embodiment, is rotatably mounted to an axle 20 to which the wheelchair wheel 12 is fixedly mounted. Also attached to the mounting member 92 is a counterweight armature 38 that includes an elongated arm 40 having a counterweight 42. The wheelchair drive mechanism 90 also comprises a tensioning mechanism 46 that includes a first or upper tensile member 48 and a second or lower tensile member 50 that apply tension to the mounting member 92 and, therefore, the drive lever 16. A tension adjustment mechanism 52 can be used to adjust the tension in the tensile members 48, 50. Furthermore, the drive mechanism 90 includes a clutch mechanism 62.

Unlike the wheelchair drive mechanism 10, however, the wheelchair drive mechanism 90 comprises no transmission and, therefore, no gears that are used to control operation of the wheelchair. Instead, operation of the wheelchair is solely controlled by actuation of the clutch mechanism 62 by the wheelchair user. Such an implementation may be desirable because of its mechanical simplicity and ease of use by the wheelchair user, as well as the therapeutic effects provided by the required coordination between actuating the clutch mechanism 62 and manipulating the drive lever 16.

Figure 7:
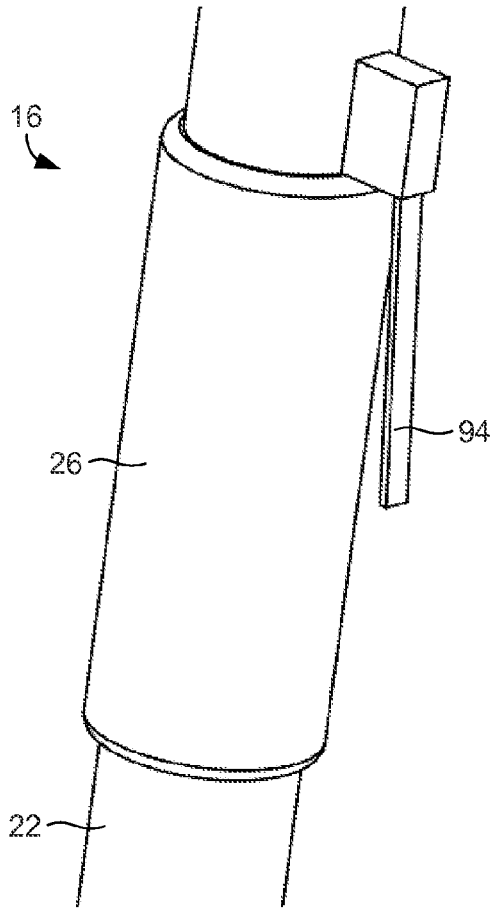
FIG. 7 is a partial perspective view of a drive lever of a wheelchair drive mechanism showing a first electrical switch used to actuate a clutch mechanism of the wheelchair drive mechanism.
Figure 8:
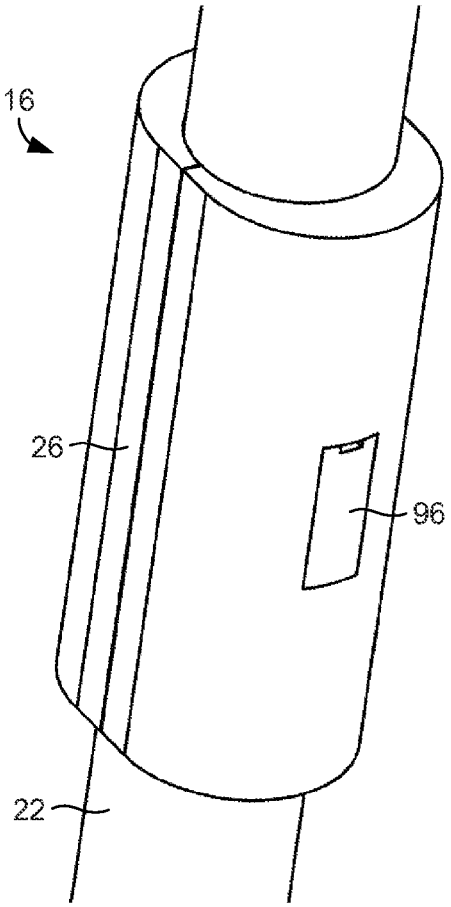
FIG. 8 is a partial perspective view of a drive lever of a wheelchair drive mechanism showing a second electrical switch used to actuate a clutch mechanism of the wheelchair drive mechanism.

In other embodiments, the actuation of the clutch mechanism can be partially automated. For example, the clutch mechanism can be electromechanically actuated by a solenoid or other electromechanical actuator when the user activates an electrical switch provided on the drive lever. FIGS. 7 and 8 illustrate examples of such switches. With reference first to FIG. 7, the clutch actuation device comprises an electrical clutch lever 94 that is mounted to the shaft 22 of the drive lever 16 adjacent to the hand grip 26 in lieu of a mechanical clutch lever. When the lever 94 is squeezed toward the grip 26, an electrical switch associated with the lever is closed and the electromechanical clutch mechanism is actuated so that the lever 16 is directly coupled to the wheelchair wheel. The clutch mechanism stays activated as long as the electrical switch is held closed but deactivates as soon as the user releases the lever 94 and the switch opens.

Referring next to FIG. 8, the clutch actuation device comprises an electrical button 96 that is integrated into the hand grip 26 so that can be easily pressed by one of the user's fingers. When the button 96 is pressed, an electrical switch associated with the button is closed and the electromechanical clutch mechanism is actuated so that the lever 16 is directly coupled to the wheelchair wheel. In some embodiments, the button 96 is associated with a force sensor, such as a pressure transducer, that measures the force with which the button is pressed and this measurement is used to control the force with which the electromechanical clutch mechanism is actuated. For example, if the button 96 is firmly pressed, the clutch mechanism can be fully engaged so that there is no slippage between the wheel and the drive lever 16. If the sensor 96 is lightly pressed, however, the clutch mechanism can only partially engage such that slippage is permitted. The latter functionality may be desirable in braking situations to enable more gradual braking. It is further noted that, when the wheelchair comprises two drive mechanisms and each has its own clutch actuation device that comprises a button 96 and an associated force sensor, when both buttons are pressed a weighted sum could be taken of the measured forces to determine how much force with which to activate the clutch mechanisms. In such a case, a stronger hand can assist a weaker hand while still requiring the weaker hand to be used.

Figure 9:
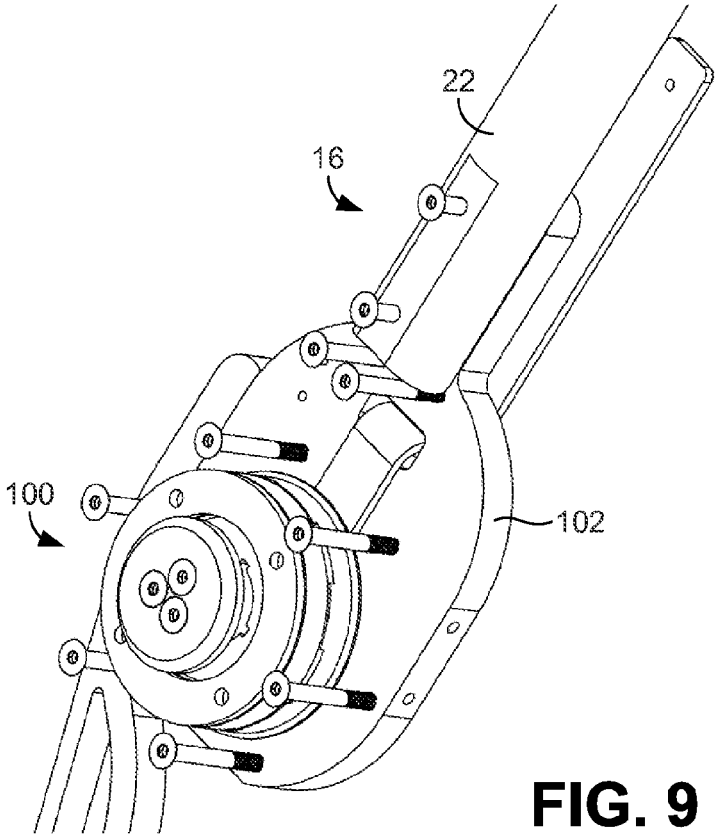
FIG. 9 is a side perspective view of an alternative clutch mechanism that can be used in a wheelchair drive mechanism.
Figure 10:
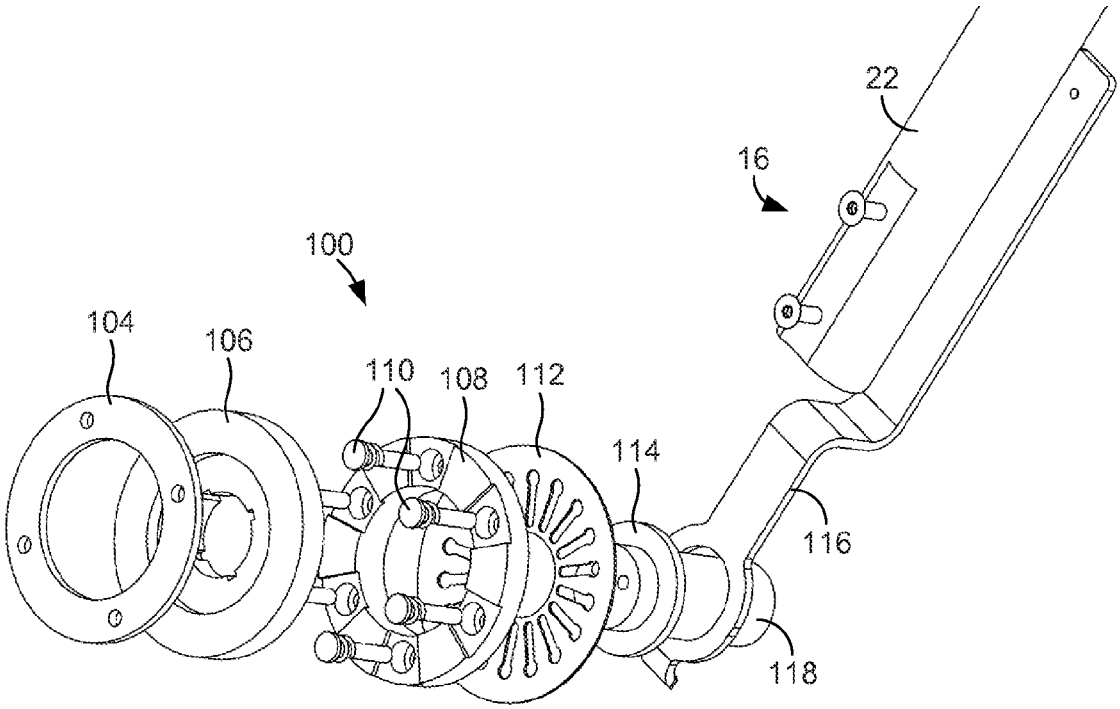
FIG. 10 is an exploded view of the clutch mechanism shown in FIG. 9

In the above-described embodiments, the clutch mechanism has been shown and described as comprising a brake disc and brake calipers. It is noted that other types of clutch mechanisms can be used. For example, the clutch mechanism can be implemented as a drum brake. Indeed, the clutch mechanism need not comprise a brake at all. In some embodiments, the clutch mechanism can comprise a friction clutch. Such an embodiment is illustrated in FIGS. 9 and 10. Beginning with FIG. 9, illustrated is an assembled friction clutch 100 that is housed within a housing 102 similar to the housing 36 used to contain the transmission 18 described above in relation to the first embodiment.

FIG. 10 shows the friction clutch 100 in an exploded view in which the various components of the clutch can be more easily identified. As indicated in FIG. 10, the friction clutch 100 comprises a backplate 104, a friction disc 106, a pressure plate 108, multiple spring-loaded pins 110 that extend through the pressure plate, a spacer 114, a clutch lever 116 that is attached to the drive lever 16, and a shaft 118. Each of the backplate 104, pressure plate 108, pins 110, and spacer 114 are coupled with the clutch lever 116 and therefore rotate with it, while the friction disc 106 is fixedly mounted to the shaft 118, which is rigidly connected to the wheelchair wheel. The clutch 100 is engaged when the pressure plate 108 is firmly pressed against the friction disc 106, thereby coupling the drive lever 16 and the wheel. During operation, the user can activate the clutch 100 either using a mechanical clutch actuation device or an electrical clutch actuation device. In the former case, the force applied to a clutch lever can be transferred to the pressure plate 108 through a Bowden or hydraulic cable. In the latter case, a solenoid or other electromechanical device can move the pressure plate 108.

The invention claimed is:

1. A wheelchair drive mechanism adapted to mount to a wheelchair having a first rear wheel mounted on a first wheel axle and a second rear wheel mounted on a second wheel axle, the drive mechanism comprising:

a first drive lever adapted to be rotatably mounted to the first wheel axle and be rotated forward and rearward by a user of the wheelchair;

a second drive lever adapted to be rotatably mounted to the second wheel axle and be rotated forward and rearward by a user of the wheelchair;

a first clutch mechanism associated with the first drive lever, wherein actuation of the first clutch mechanism causes the first drive lever to be coupled to the first rear wheel of the wheelchair such that they rotate together in both forward and rear directions;

a second clutch mechanism associated with the second drive lever, wherein actuation of the second clutch mechanism causes the second drive lever to be coupled to the second rear wheel of the wheelchair such that they rotate together in both forward and rear directions; and a clutch actuation device provided on one of the drive levers that is operable by the wheelchair user to simultaneously actuate both clutch mechanisms.

2. The drive mechanism of claim 1, wherein the clutch mechanisms each comprise a disc brake.

3. The drive mechanism of claim 1, wherein the clutch mechanisms each comprise a drum brake.

4. The drive mechanism of claim 1, wherein the clutch mechanisms each comprise a friction clutch.

5. The drive mechanism of claim 1, wherein the clutch actuation device comprises a clutch lever that mechanically actuates the clutch mechanisms when the clutch lever is squeezed by the wheelchair user.

6. The drive mechanism of claim 1, wherein the clutch actuation device comprises an electrical switch that electrically actuates the clutch mechanisms when the switch is closed by the wheelchair user.

7. The drive mechanism of claim 6, wherein the clutch actuation device further comprises a force sensor that measures a force with which the user activates the clutch actuation device.

8. The drive mechanism of claim 1, wherein the drive levers each comprise a forearm support adapted to support a forearm of the wheelchair user.

9. The drive mechanism of claim 1, further comprising first and second tensioning mechanisms that oppose forward rotation of the first and second drive levers.

10. The drive mechanism of claim 9, wherein the tensioning mechanisms each comprise a tensile member that opposes forward rotation of the associated drive lever.

11. The drive mechanism of claim 10, wherein the tensioning mechanisms each further comprise a tension adjustment mechanism that is adapted to adjust the tension of the associated tensile member.

12. The drive mechanism of claim 1, further comprising first and second transmissions associated with the wheelchair wheels that are configurable in a freewheeling configuration in which rotation of the associated drive lever is independent of rotation of the wheelchair wheel and a driving configuration in which forward rotation of the associated drive lever causes forward rotation of the wheelchair wheel but rearward rotation of the drive lever has no effect on the wheelchair wheel.

13. The drive mechanism of claim 1, further comprising first and second weights that are associated with the first and second drive levers that facilitate harmonic resonance of the levers.

14. A wheelchair that can be operated by a wheelchair user, the wheelchair comprising:

a wheelchair frame;

first and second wheel axles supported by the frame;

first and second rear wheels mounted to the first and second wheel axles; and a drive mechanism including:

a first drive lever rotatably mounted to the first wheel axle and adapted to be rotated forward and rearward by the wheelchair user, a second drive lever rotatably mounted to the second wheel axle and adapted to be rotated forward and rearward by the wheelchair user, a first clutch mechanism associated with the first drive lever, wherein actuation of the first clutch mechanism causes the first drive lever to be coupled to the first rear wheel such that they rotate together in both forward and rear directions, a second clutch mechanism associated with the second drive lever, wherein actuation of the second clutch mechanism causes the second drive lever to be coupled to the second rear wheel such that they rotate together in both forward and rear directions, and a clutch actuation device provided on one of the drive levers that is operable by the wheelchair user to simultaneously actuate both clutch mechanisms.

15. The wheelchair of claim 14, wherein the drive levers are rotatably mounted to the wheel axles.

16. The wheelchair of claim 14, wherein the clutch actuation device comprises a clutch lever that mechanically actuates the clutch mechanisms when the clutch lever is squeezed by the wheelchair user.

17. The wheelchair of claim 14, wherein the clutch actuation device comprises an electrical switch that electrically actuates the clutch mechanisms when the switch is closed by the wheelchair user.

18. The wheelchair of claim 17, wherein the clutch actuation device further comprises a force sensor that measures a force with which the user activates the clutch actuation device.

19. The wheelchair of claim 14, wherein the drive levers each comprise a forearm support adapted to support a forearm of the wheelchair user.

20. The wheelchair of claim 14, wherein the drive mechanism further comprises first and second tensioning mechanisms that oppose forward rotation of the first and second drive levers.

21. The wheelchair of claim 20, wherein the tensioning mechanisms each comprise a tensile member that opposes forward rotation of the associated drive lever.

22. The wheelchair of claim 21, wherein the tensioning mechanisms each further comprise a tension adjustment mechanism that is adapted to adjust the tension of the associated tensile member.

23. The wheelchair of claim 14, wherein the drive mechanism further comprises first and second transmissions associated with the first and second wheelchair wheels that are configurable in a freewheeling configuration in which rotation of the associated drive lever is independent of rotation of the wheelchair wheel and a driving configuration in which forward rotation of the associated drive lever causes forward rotation of the wheelchair wheel but rearward rotation of the drive lever has no effect on the wheelchair wheel.

24. The wheelchair of claim 14, wherein the drive mechanism further comprises first and second weights that are associated with the first and second drive levers that facilitate harmonic resonance of the levers.

* * * * *